US007529510B2

(12) United States Patent
Hirota et al.

(10) Patent No.: US 7,529,510 B2
(45) Date of Patent: May 5, 2009

(54) IMAGE FORMING APPARATUS WITH DEVELOPING DEVICE HAVING DISCHARGE OPENINGS

(75) Inventors: Takashi Hirota, Kobe (JP); Katsumi Adachi, Ikoma-gun (JP); Shuichi Akedo, Sakai (JP)

(73) Assignee: Sharp Kabushiki Kaisha, Osaka (JP)

( * ) Notice: Subject to any disclaimer, the term of this patent is extended or adjusted under 35 U.S.C. 154(b) by 422 days.

(21) Appl. No.: 11/408,962

(22) Filed: Apr. 24, 2006

(65) Prior Publication Data

US 2006/0239720 A1 Oct. 26, 2006

(30) Foreign Application Priority Data

Apr. 26, 2005 (JP) ..... 2005-128514

(51) Int. Cl.
*G03G 15/08* (2006.01)

(52) U.S. Cl. ..... 399/258; 399/262; 399/263

(58) Field of Classification Search ..... 399/258, 399/262, 263, 257
See application file for complete search history.

(56) References Cited

U.S. PATENT DOCUMENTS

| | | | | |
|---|---|---|---|---|
| 4,147,426 | A * | 4/1979 | Miyoshi et al. | 399/258 |
| 4,614,165 | A | 9/1986 | Folkins et al. | |
| 5,430,532 | A * | 7/1995 | Ueda et al. | 399/263 |
| 7,356,288 | B2 * | 4/2008 | Iwata et al. | 399/257 |
| 7,376,374 | B2 * | 5/2008 | Adachi | |
| 2003/0026628 | A1 * | 2/2003 | Arimoto | 399/258 |
| 2003/0235436 | A1 * | 12/2003 | Kasahara et al. | 399/258 |

FOREIGN PATENT DOCUMENTS

| | | | | |
|---|---|---|---|---|
| JP | 2-21591 | B2 | | 5/1990 |
| JP | 6-27809 | A | | 2/1994 |
| JP | 7-104570 | A | | 4/1995 |
| JP | 10-48937 | A | | 2/1998 |
| JP | 10-228175 | A | | 8/1998 |
| JP | 11-202630 | | | 7/1999 |
| JP | 3034736 | B2 | | 2/2000 |
| JP | 2001-42624 | A | | 2/2001 |
| JP | 2001-255743 | A | | 9/2001 |
| JP | 2004-258481 | A | | 9/2004 |
| JP | 3603492 | B2 | | 10/2004 |
| JP | 2005-91914 | A | | 4/2005 |
| JP | 2005-92059 | A | | 4/2005 |
| JP | 2005-99134 | A | | 4/2005 |
| JP | 2005-221852 | A | | 8/2005 |
| JP | 2005292511 | A | * | 10/2005 |
| JP | 2006208577 | A | * | 8/2006 |
| JP | 2006285024 | A | * | 10/2006 |
| JP | 2006308689 | A | * | 11/2006 |
| JP | 2007102098 | A | * | 4/2007 |
| JP | 2007156355 | A | * | 6/2007 |

* cited by examiner

*Primary Examiner*—David M Gray
*Assistant Examiner*—Laura K Roth
(74) *Attorney, Agent, or Firm*—Nixon & Vanderhye, P.C.

(57) ABSTRACT

A developing device using a trickle system is realized which includes developer discharging means for (i) suppressing changes in discharge of developer due to inclinations of the developing device and (ii) maintaining the stability in amount of the developer in a developer tank. In the developing device, the developer tank includes agitating chambers parted by a partition, and each of the agitating chambers has an agitating screw. Further, discharging openings for discharging an excess of the developer in the developer tank are provided downstream in transport directions of the agitating screws, respectively.

12 Claims, 15 Drawing Sheets

(TOP VIEW)

(FRONT VIEW)

IMAGE FORMING APPARATUS WITH DEVELOPING DEVICE HAVING DISCHARGE OPENINGS

This Nonprovisional application claims priority under 35 U.S.C. § 119(a) on Patent Application No. 128514/2005 filed in Japan on Apr. 26, 2005, the entire contents of which are hereby incorporated by reference.

FIELD OF THE INVENTION

The present invention relates to (i) a developing device which is used in an image forming apparatus such as a copier, a printer, a facsimile machine, or the like, and which develops, using toner, an electrostatic latent image formed on an image support section, and (ii) an image forming apparatus having the developing device. The present invention particularly relates to (i) a developing device using a two component developer including toner and carrier, and (ii) an image forming apparatus having the developing device.

BACKGROUND

There has been a problem in a two component developing system with regard to its performance degradation. One of the causes of the problem is performance degradation of a carrier. Such performance degradation of the carrier includes adhesion of toner to the carrier (so-called "spent phenomenon"), peeling of coating applied to a surface of a carrier particle, and the like. Conventionally, there have been proposed various systems for suppressing such performance degradation of carrier.

For example, Japanese Examined Patent Publication, No. 111598/1987 (Tokukohei 7-111598, publication date: Jun. 10, 1987: Patent document 1) and Japanese Examined Patent Publication, No. 21591/1984 (Tokukohei 2-21591, publication date: Jun. 9, 1984: Patent document 2) describe developing devices using a so-called "trickle" system. In the developing devices disclosed in these publications, a small amount of carrier is supplied as toner is replenished, while an excess of the carrier (or the mixture of carrier and toner) in a developing device is discharged. This allows carrier in the developing device to have performance changing within a certain range, thereby achieving stability in the performance of the carrier over time.

In the trickle system, it is important to discharge developer by an amount corresponding to an amount of replenished developer (carrier), so as to maintain a certain amount of the developer in a developing device. This is because fluctuations in amount of the developer in the developing device adversely affect image quality.

However, in the developing devices disclosed in Patent documents 1 and 2, the developer is discharged by a natural discharging system, which causes the developer to overflow (overflow system). Specifically, the developer is added by an amount of replenished developer, and the developer is discharged by an amount exceeding the level of a discharging opening. This allows fluctuations in amount of the developer in the developing device to be within a predetermined range.

In such a simple overflow system, discharge of developer is subject to an inclination of a main body of an image forming apparatus, so that discharge of developer in a developing device becomes excessive, or inhibited contrary.

With reference to FIGS. 16(*a*) through 16(*c*), the above operations are described below in more detail. In a developing device, a discharging opening 100 is provided on one of the edges (right edge in the figures) of a developer tank 101 in its longitudinal direction. As shown in FIG. 16(*a*), under a normal (horizontal) setting condition of the developing device 100, when the developer tank 101 contains developer with a predetermined amount of Z(g), a top face of the developer in the developer tank (indicated by a dash-dotted line) is at a level of a bottom end of the discharging opening 100. Thus, the amount of developer in the developer tank is stabilized to be the predetermined amount of Z(g).

However, as shown in FIG. 16(*b*), when the developing device is inclined so that the end portion having the discharging opening 100 becomes lower than the other end, the top surface (indicated by a dash-dotted line) of the developer with the amount of Z(g) exceeds the top face of the discharging opening 100. This causes the developer to be discharged until the top face of the developer comes to the bottom end of the discharging opening 100. As a result, the amount of the developer in the developer tank 101 is stabilized to be an amount of Z−X (g), which is less than the predetermined amount of Z(g) by the amount of X(g).

On the contrary, as shown in FIG. 16(*c*), when the developing device is inclined so that the end portion having the discharging opening 100 becomes higher than the other end, the top surface (indicated by a dash-dotted line) of the developer with the amount of Z(g) does not reach the top face of the discharging opening 100. This causes the developer to be replenished until the top face of the developer comes to the bottom end of the discharging opening 100. As a result, the amount of the developer in the developer tank 101 is stabilized to be an amount of Z+Y (g), which is larger than the predetermined amount of Z(g) by the amount of Y(g).

As a method for suppressing changes in amount of the developer due to the inclinations of a developing device, for example, an excess of the developer is discharged by (i) providing a shutter member on a wall surface of a developer tank, (ii) detecting a predetermined amount of printing or an amount of the developer in a developing device, and (iii) opening or closing the shutter member based on the detection signals. Further, Japanese Patent Publication, No. 3034736 (publication date: May 12, 1995: Patent document 3) discloses a developing device in which a discharging opening is provided on the middle portion of the developing device in its longitudinal direction, so that inclinations of the developing device have less effect on the amount of the developer.

However, in the trickle system, since an excess of the developer is a trace, there is a difficulty in accurately discharging such a minute amount of the developer using a shutter member. This causes difficulties in maintaining a predetermined amount of the developer with high accuracy.

Further, the method as disclosed in Patent document 3, in which the developer discharging opening is disposed on the middle portion of the developing device in its longitudinal direction, is not effective for a developing device that performs circulating and agitating operation using a screw and that is used in color coping machines or the like requiring high performance capabilities for the agitating operation. This is because, even in the case where the discharging opening is disposed on the middle portion of the developing device in its longitudinal direction, the circulating and agitating operation of a screw is significantly affected by inclinations of the surface of the developer. Further, in the developing device of Patent document 3, the method is not effective with regard to inclinations in a direction orthogonal to the longitudinal direction.

Further, Publication of Japanese Patent, No. 3603492/1998 (publication date: Feb. 20, 1998: Patent document 4) discloses a developing device having a plurality of discharging openings. In the developing device in this publication, the discharging openings are provided at different positions including a position where the flow of developer retains and a position where the flow of the developer is stable. This makes it difficult for the developing device to achieve stability in amount of the developer when the developing device is inclined.

SUMMARY

The technology disclosed herein is made in view of the foregoing problems, and an object of the technology disclosed herein is to realize a developing device using the trickle system, which includes developer discharging means for (i) suppressing changes in discharge of developer due to inclinations of the developing device and (ii) maintaining the stability in amount of the developer in a developer tank.

To solve the foregoing problems, a developing device of the technology disclosed herein, in which a two component developer including toner and carrier is supplied into a developer tank, which developer tank includes developer discharging openings for discharging an excess of the two component developer in response to replenishment of the two component developer, the number of the developer discharging openings being at least one provided in the vicinity of each edge of the developing device in a longitudinal direction of the developing device.

According to the arrangement, the developer discharging openings are disposed at least one in the vicinity of each edge of the developing device in its longitudinal direction. This allows the developer discharging openings to have reverse characteristics in response to increase and decrease in amount of the developer when the developing device is inclined in its longitudinal direction. That is, when the inclination of the developing device is made in its longitudinal direction, regardless of any side the developing device is leaned to, at least one of the developer discharging openings lowers. This may cause a reduction in amount of the developer in the developer tank due to the inclination, while causing no increase in the amount. As a result, it is possible to reduce changes in amount of the developer due to the inclination of the developing device.

Additional objects, features, and strengths of the technology disclosed herein will be made clear by the description below. Further, the advantages of the technology disclosed herein will be evident from the following explanation in reference to the drawings.

DESCRIPTION OF THE EMBODIMENTS

Figure 2:
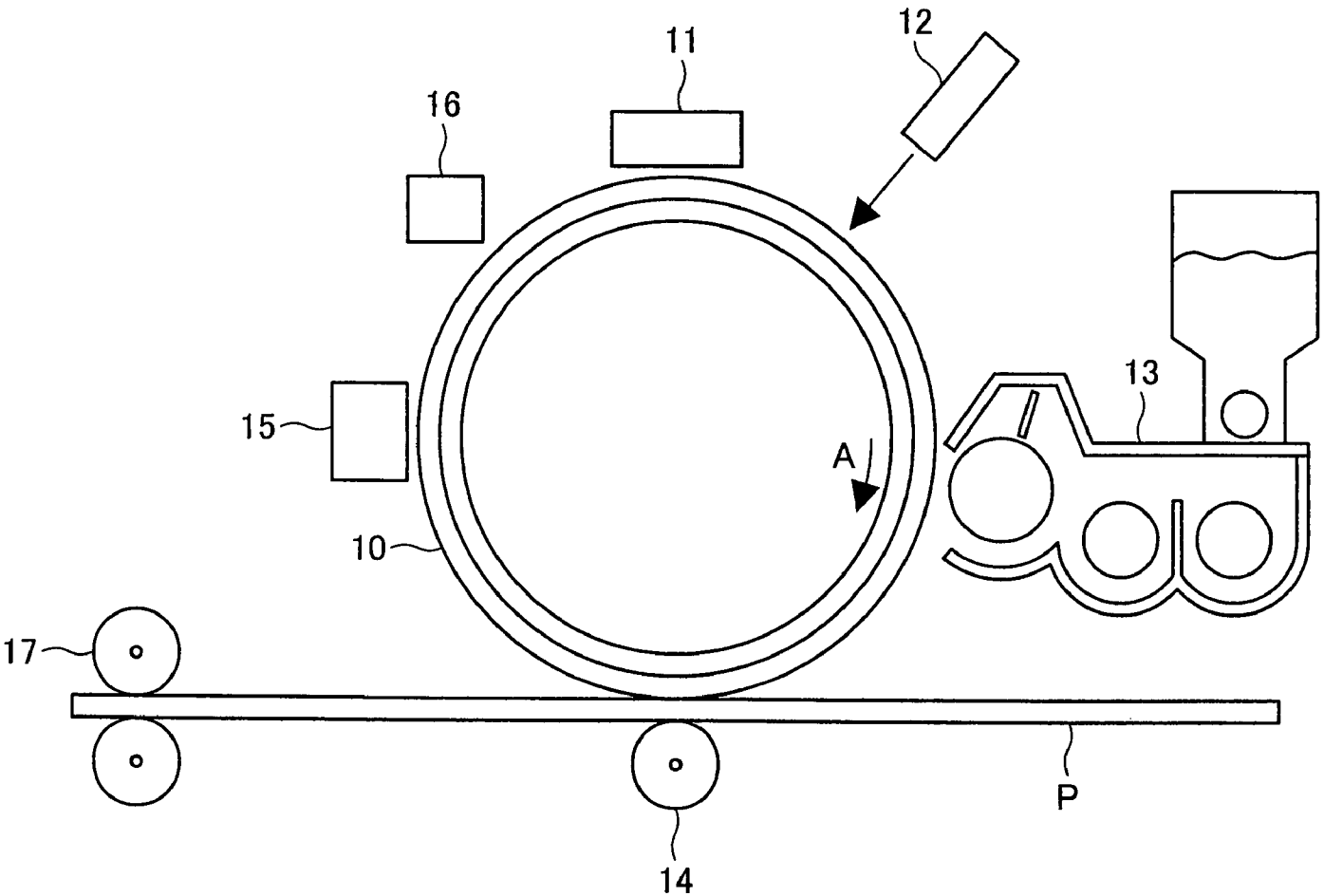
FIG. 2 is a cross-sectional view illustrating substantial parts of an image forming apparatus to which the developing device of the embodiment is applied.

With reference to figures, the following describes one example embodiment of the technology disclosed herein. Referring to FIG. 2, description is made as to an exemplary structure of an image forming apparatus to which a developing device of the technology disclosed herein is applied.

The image forming apparatus shown in FIG. 2 employs an electrophotographic process. The image forming apparatus includes a charging member 11, an exposure member 12, a developing device 13, a transfer member 14, a cleaning member 15, and a static eliminating member 16, which are disposed in this order so as to surround a cylindrical photoreceptor 10 in the center. Between the photoreceptor 10 and the transfer member 14, a sheet P as a recording medium is conveyed via a sheet conveyer path. Further, a fixing member 17 is disposed downstream of the photoreceptor 10 in a direction along which a sheet is conveyed via the sheet conveyer path. The image forming apparatus of the technology disclosed herein is not limited to the above structure, and may include other members.

In the electrophotographic process, an electrostatic latent image is formed on the photoreceptor 10 serving as an image support section by the charging member 11 and exposure member 12. Then, the electrostatic latent image is visualized by the developing device 13, so as to become a toner image.

The photoreceptor 10 includes a substrate and a photoconductive layer disposed on the substrate. The photoreceptor 10 is capable of rotating so as to face the members in the aforesaid order starting from the charging member 11. Specifically, the photoreceptor 10 rotates in a direction indicated by an arrow A in FIG. 2. First, a surface of the photoreceptor 10 is charged by the charging member 11 so as to have a predetermined voltage. The surface of the photoreceptor 10 thus charged to have the predetermined voltage is moved to the position of the exposure member 12 by rotation of the photoreceptor 10. The exposure member 12 serving as writing means writes, based on image information, an image on the surface of the photoreceptor 10 charged by, for example, a laser beam. In this way, an electrostatic latent image is formed on the photoreceptor 10. Such an electrostatic latent image is formed based on (i) a document image read by reading means such as a scanner or the like or (ii) image information corresponding to data sent from a host computer. The portion of the surface of the photoreceptor 10, on which the electrostatic latent image is formed, moves to the position of the developing device 13 by rotation of the photoreceptor 10 and is visualized by the developing device 13, so as to become a toner image.

The toner image visualized by the developing device 13 is transferred to the sheet P by the transfer member 14 and fixed on the sheet P by the fixing member 17, so that the image is formed. The cleaning member 15 serves to remove toner, paper powder, and the like which are remained on the photoreceptor 10. Further, the static eliminating member 16 serves to remove charges remained on the photoreceptor 10. Through a series of the above operations, one cycle of image formation is completed.

The photoreceptor 10 includes (i) a substrate, e.g. a metal drum made of aluminum or the like, and (ii) a thin photoconductive layer disposed on an outer surface of the substrate. The photoconductive layer is made of amorphous silicon (a-Si), amorphous selenium (Se), an organic photo conductor (OPC), or the like.

Examples of the charging member 11 are (i) a corona charging device constituted by a charging wire such as a tungsten wire or the like, a metal shielding plate, a grid plate, and the like, (ii) a charging roller, (iii) a charging brush, and (iv) the like.

Examples of the exposure member 12 are a semiconductor laser, a light emitting diode, and the like. Examples of the transfer member 14 are a corona transfer device, a transfer roller, a transfer brush, and the like. Further, the cleaning member 15 is, for example, a cleaning blade or the like, and the static eliminating member 16 is a static eliminating lamp or the like, for example.

FIG. 2 illustrates the exemplary structure of the image forming apparatus that performs monochrome printing. However, in order to perform color image formation, the image forming apparatus may be a tandem type in which at least three developing devices and photoreceptors are provided for toners with respective colors, or may be arranged such that a single photoreceptor rotates three or four times to overlay the multiple colors. As to such techniques, detailed descriptions are omitted here since known prior arts can be applied.

Figure 1:
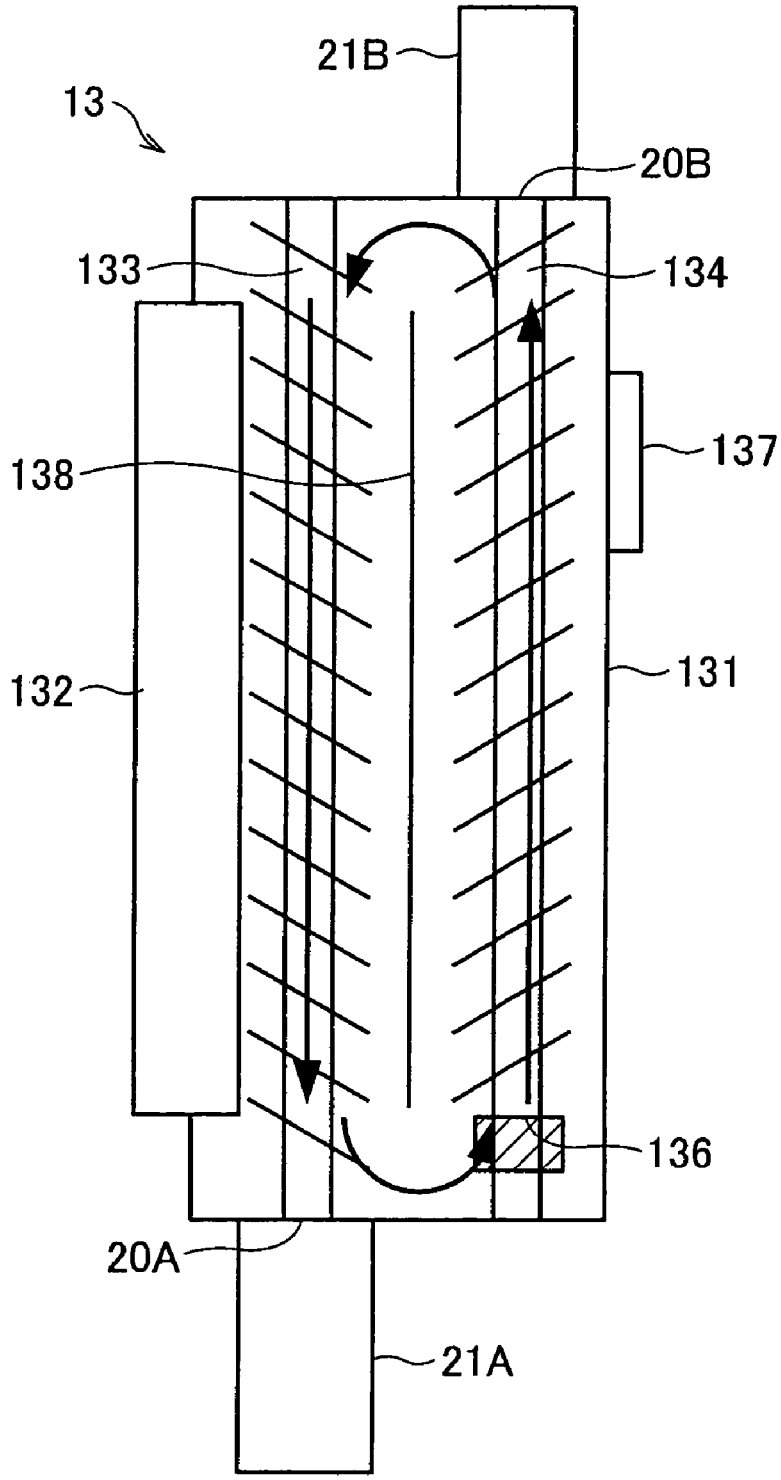
FIG. 1 is a top view illustrating a structure of substantial parts of a developing device according to one example embodiment.
Figure 3:
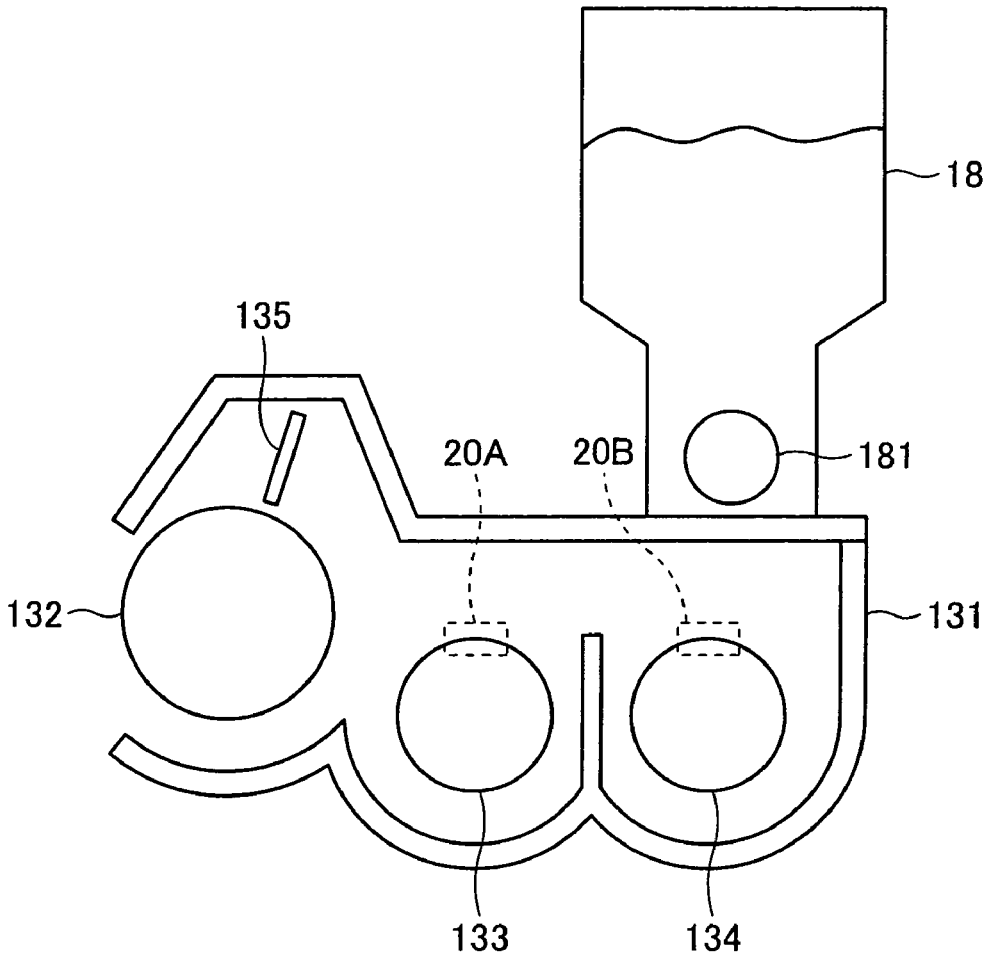
FIG. 3 is a cross-sectional view illustrating a structure of substantial parts of the developing device of the embodiment.

Referring to FIGS. 1 and 3, the following describes an exemplary structure of the developing device 13. FIG. 1 is a top view illustrating the developing device 13 viewed from above, and FIG. 3 is a cross-sectional view of the developing device 13.

As illustrated in FIGS. 1 and 3, the developing device 13 has a developer tank 131 having the shape of a container. Further, inside the developer tank 131, a development roller 132 and agitating screws 133 and 134 are provided. The development roller 132 is a magnet roller, and the agitating screws 133 and 134 serving as agitating means are capable of rotating freely. In FIG. 1, the development roller 132, the agitating screws 133 and 134 are also illustrated which are provided inside the developer tank 131. Developer contained in the developer tank 131 is a two component developer including carrier and toner. The developer is normally set such that the weight of the toner becomes approximately several percents of the total weight of the developer. In the following description, developer refers to a mixture of carrier and toner unless otherwise specified.

The carrier includes a layer coated with resin provided on a surface of each magnetic particle. The layer coated with resin serves to control the electrostatic properties of the toner and to suppress the viscosity of the toner. Alternatively, the carrier may be resin-coated carrier or the like in which magnetic fine particles are distributed among the resin particles.

When the developer is agitated by the agitating screws 133 and 134, the toner becomes triboelectrically charged. Then, the development roller 132 sucks the carrier by a magnetic force, so that a magnetic brush is formed and thereby the carrier is transported. This allows toner, adhered to the carrier, to be supplied to the photoreceptor 10 and sucked onto an electrostatic latent image formed on the photoreceptor 10. As a result, development is realized. The magnetic brush in the development roller 131 is arranged such that the height of its spikes is controlled by a doctor blade 135. Further, the agitating members are not limited to the screw type such as the agitating screws 133 and 134, and other types in the form of a paddle and the like may be also used.

On an upper surface of the developer tank 131, an opening 136 for replenishing developer is provided (see FIG. 1). Further, on the opening 136 for replenishing-use, a developer supplying unit 18 is provided from above (see FIG. 3). The developer supplying unit 18 contains the developer in which carrier and toner are mixed with predetermined percentages. Here, the developer is set such that the toner has a weight of approximately 70% to 95% to the total weight of the developer and only a slight amount of the carrier is supplied together with the toner.

In the bottom part of the developer supplying unit 18, a developer supplying roller 181 is provided which is driven and controlled by a control device (not shown). As the developer supplying roller 181 is driven and rotated, the developer is flowed from the developer supplying unit 18 into the developer tank 131. An amount of the developer thus flowed corresponds to a time during which the developer supplying roller 181 is driven. Further, the developer, supplied into the developer tank 131, is agitated and transported by the agitating screws 133 and 134.

On the other hand, on side walls of edges of the developer tank 131, discharging openings 20A and 20B for discharging the developer are formed. The discharging openings 20A and 20B serve to discharge developer, which overflows from the developer tank 131, into collecting containers 21A and 21B. Specifically, through the discharging openings 20A and 20B formed on the side walls of the developer tank 131, an excess of the developer is overflowed and discharged, in accordance with the surface level of the developer in the developer tank 131. As to a mechanism, which includes the discharging openings 20A and 20B and the collecting containers 21A and 21B, for discharging an excess of the developer, description will be made later in more detail.

Further, in the developer tank 131, a toner concentration sensor 137 is provided that detects a concentration of toner in the developer tank 131. The toner concentration sensor 137, constituted by a magnetic permeability sensor, comes in contact with the toner and detects a magnetic permeability of toner transported into the developer tank 131. Based on the magnetic permeability thus detected by the toner concentration sensor 137, a ratio of the toner to the carrier is obtained.

For example, as a result of the detection, if the developer being in contact with the toner concentration sensor 137 contains a small amount of carrier, the toner ratio is high. On the other hand, if the developer being in contact with the toner concentration sensor 137 contains a large amount of carrier, the toner ratio is low. Further, the toner concentration sensor 137 outputs a detection signal to a control device (not shown). Based on the detection signal, the developer supplying roller 181 in the developer supplying unit 18 is driven, so that the developer is replenished into the developer tank 131.

Figure 4:
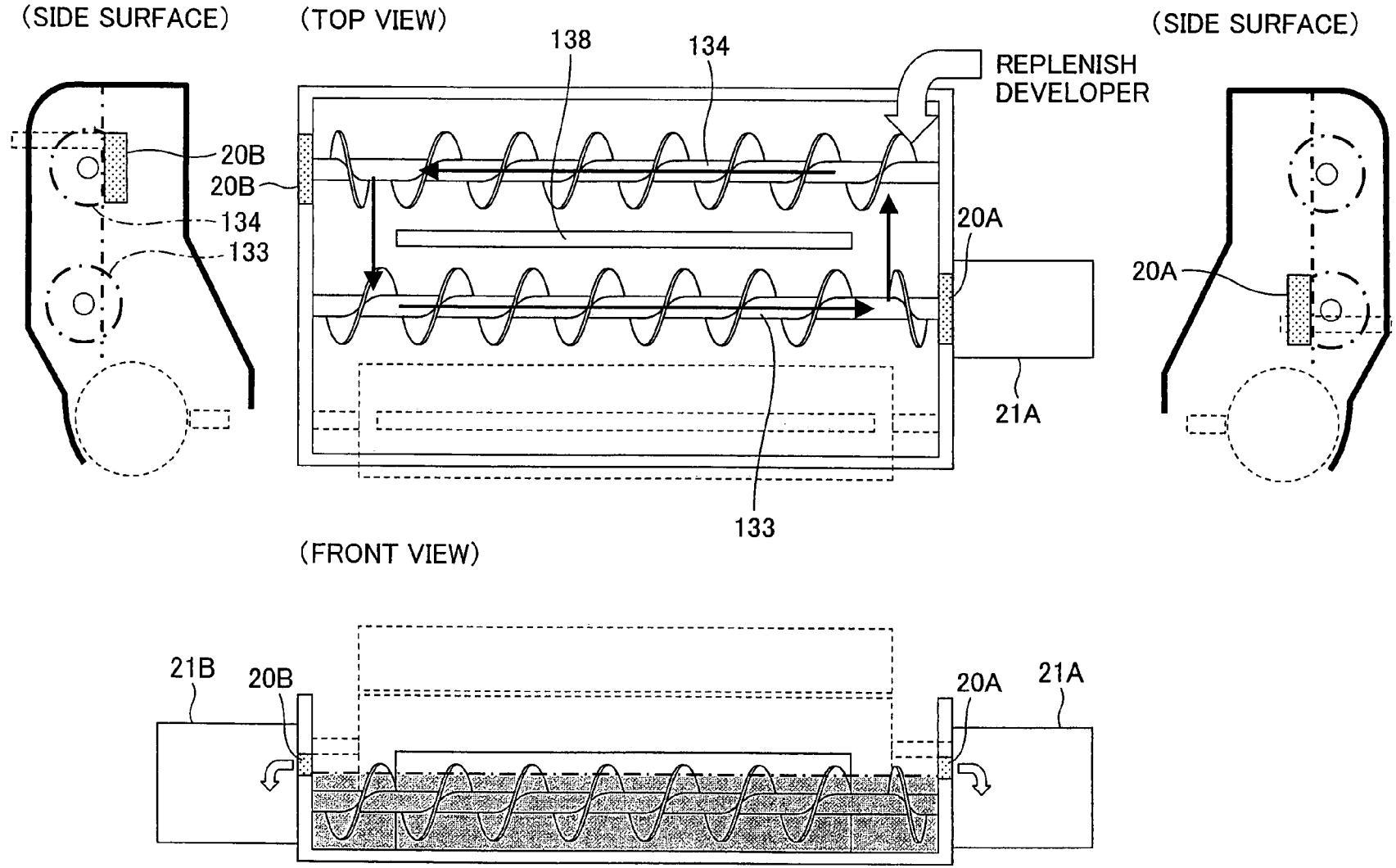
FIG. 4 is a projected view illustrating an exemplary structure of the developing device of the embodiment.

With reference to FIG. 4, features of the developing device 13 of the present embodiment are described using a more specific structure.

The developing device 13 shown in FIG. 4 includes two agitating and transporting members of a screw type (i.e., agitating screws 133 and 134) for agitating and transporting developer. Between the agitating screws 133 and 134, a partition 138 is disposed so that agitating regions are provided for the agitating screws 133 and 134, respectively. With the agitating screws 133 and 134 and the partition 138, paths for agitating and transporting a developer are formed in the developing device 13 as indicated by arrows in FIG. 4. In the developing device 13, as the concentration of toner in the developer is reduced in response to printing operation, toner and a slight amount of carrier are simultaneously replenished from a toner replenishing section, and the developer is transported through the paths for agitating-use and transporting-use.

Further, in the agitating screws 133 and 134 shown in FIG. 4, wing members are provided downstream in respective transport directions of the screws. The wing members have reversed pitches from each other. With the wing members, a situation is prevented from arising where the developer thus transported is pored into bearing sections, especially into the portions close to a developer tank of the agitating screws 133 and 134, so that operation of the bearing sections is aggravated and smooth rotation of the agitating screws 133 and 134 is hindered.

Further, since the developing device 13 shown in FIG. 4 employs the trickle system, discharging openings 20A and 20B for discharging an excess of the developer are provided, which is a typical structure of the trickle system. The discharging openings 20A and 20B are disposed at a level equal to a surface level of the developer in the vicinity of the discharging openings 20A and 20B when a predetermined amount of the developer is filled with the developing device 13. As used herein, the predetermined amount of the developer is an amount of the developer that is constantly required to be in the developing device 13 (fixed amount) so that the amount of the developer will not change.

As the developer is replenished, the amount of the developer in the developing device 13 increases. When the surface level of the developer becomes higher than the level of the discharging openings 20A and 20B, an excess of the developer overflows, so as to be discharged through the discharging openings 20A and 20B. That is, the developing device 13 employs a so-called overflow system.

Outside the discharging openings 20A and 20B, the collecting containers 21A and 21B are provided that are used for discharging the discharged developer to collecting means (not shown). Further, the collecting containers 21A and 21B contain discharging means for discharging the developer. The discharging means may be a screw type member for forcedly transporting and discharging the developer to the outside, or may be a type allowing a bottom portion of each discharging tube to be inclined downward so that the developer is automatically discharged.

As described above, the developing device 13 of the present embodiment is provided with the discharging openings 20A and 20B, which are disposed on side walls located opposite the axial directions of the agitating screws 133 and 134, respectively. In the example shown in FIG. 4, the discharging openings 20A and 20B are disposed downstream in the respective transport directions of the agitating screws 133 and 134.

Figure 5:
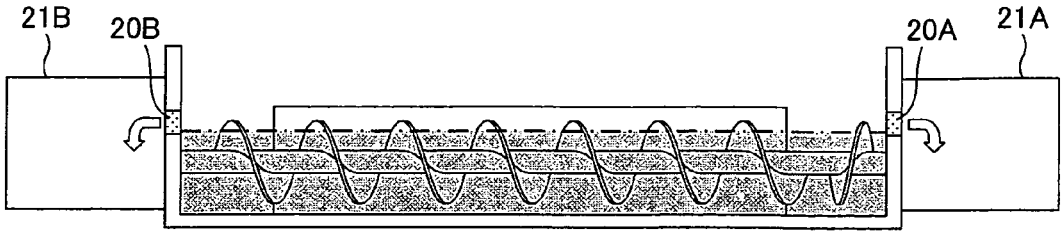
FIGS. 5(*a*) through 5(*c*) are views illustrating fluctuations in amount of developer due to inclinations of the developing device of the embodiment.
Figure 5:
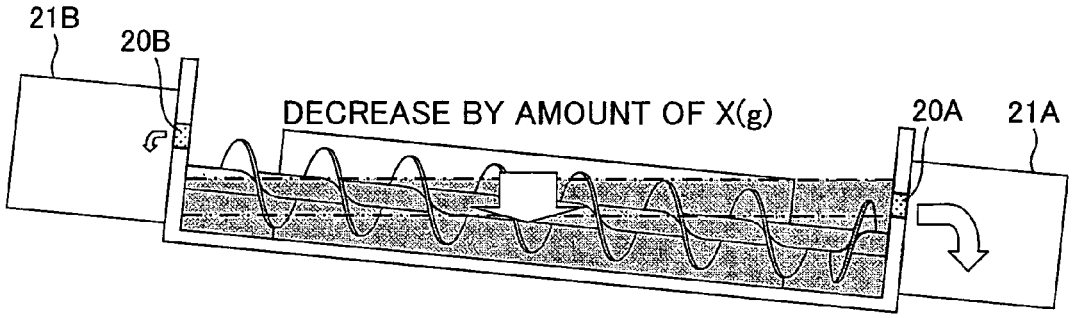
Figure 5:
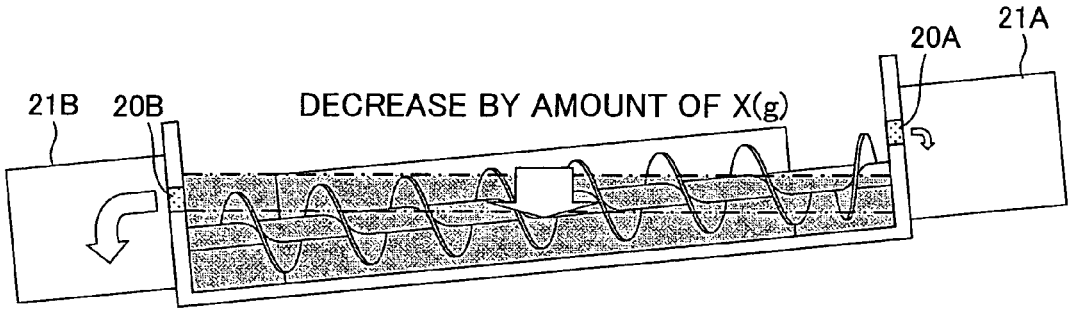

With reference to FIGS. 5(*a*) through 5(*c*), the following describes effects achieved by the developing device 13 of the present embodiment. The following takes into consideration the situation where developing operation is not carried out and a slight amount of developer is replenished at a certain rate (by a weight of developer replenished or discharged per unit of time).

When the developing device 13 is set in a normal state, i.e., when the developing device 13 is set on a horizontal plane, bottom edges of the discharging openings 20A and 20B of the developing device 13 are at a horizontal level. In this state, as shown in FIG. 5(*a*), developer is discharged through the discharging openings 20A and 20B. When the amount of the developer in the developing device 13 becomes Z(g), a rate of discharging the developer and a rate of replenishing the developer become equal and the amount of the developer in the device becomes constant. Since the rate of discharging the developer is extremely small, the surface level of the developer in the developing device 13 is slightly higher than the bottom surfaces of the discharging openings 20A and 20B. Note that, even in a conventional developing device (having an identical structure with the developing device 13 except that only a discharging opening equivalent to the discharging opening 20A is provided and no discharging opening equivalent to the discharging opening 20B is provided), when the developing device is set in the normal state, the amount of the developer in the developing device becomes constant after becoming Z(g) (see FIG. 16(*a*)).

Assume that the developing device, set in the foresaid horizontal and stable state, is inclined so that the discharging opening 20A becomes lower than the discharging opening 20B. In this state, the developer is discharged through the discharging opening 20A, as shown in FIG. 5(*b*). In this case, since the surface level of the developer in the vicinity of the discharging opening 20A becomes higher than the discharging opening 20A, the developer is further discharged. On the other hand, since the surface level of the developer in the vicinity of the discharging opening 20B becomes lower than the discharging opening 20B, nearly no developer is discharged through the discharging opening 20B.

As a result, the amount of the developer Z(g) is reduced by an amount of X(g). When the amount of the developer in the developing device is reduced and becomes an amount of Z−X(g), the rate of discharging the developer and the rate of replenishing the developer become equal. This allows the amount of the developer in the device to be constant. In this state, the surface level of the developer in the developing device 13 is slightly higher than the bottom surface of the discharging opening 20A. Even in the conventional developing device (having the identical structure with the developing device 13 except that only the discharging opening equivalent to the discharging opening 20A is provided and no discharging opening equivalent to the discharging opening 20B is provided), when the developing device is inclined so that the end portion having the discharging opening becomes lower than the other end, the amount of the developer in the developing device becomes constant after becoming Z−X(g) (see FIG. 16(*b*)).

Assume that the developing device, set in the foresaid horizontal and stable state, is inclined so that the discharging opening 20A becomes higher than the discharging opening 20B. In this state, the developer is discharged through the discharging opening 20B, as shown in FIG. 5(*c*). Since the surface level of the developer in the vicinity of the discharging opening 20B becomes higher than the discharging opening 20B, the developer is further discharged. On the other hand, since the surface level of the developer in the vicinity of the discharging opening 20A becomes lower than the discharging opening 20A, nearly no developer is discharged through the discharging opening 20A.

As a result, the amount of the developer Z(g) is reduced by an amount of X(g). When the amount of the developer in the developing device is reduced and becomes the amount of Z−X(g), the rate of discharging the developer and the rate of replenishing the developer become equal. This allows the amount of the developer in the device to be constant. In this state, the surface level of the developer in the developing device 13 is slightly higher than the bottom surface of the discharging opening 20B.

Figure 16:
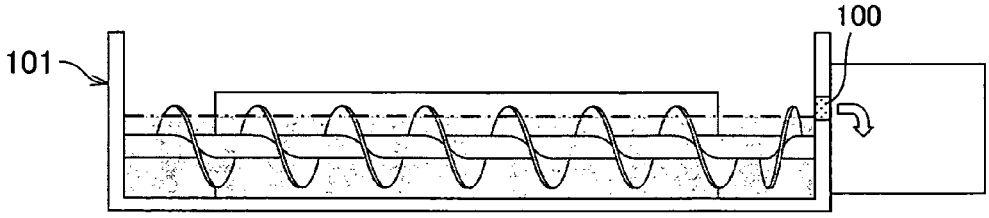
FIGS. 16(*a*) through 16(*c*) are views illustrating fluctuations in amount of developer due to inclinations of a conventional developing device.
Figure 16:
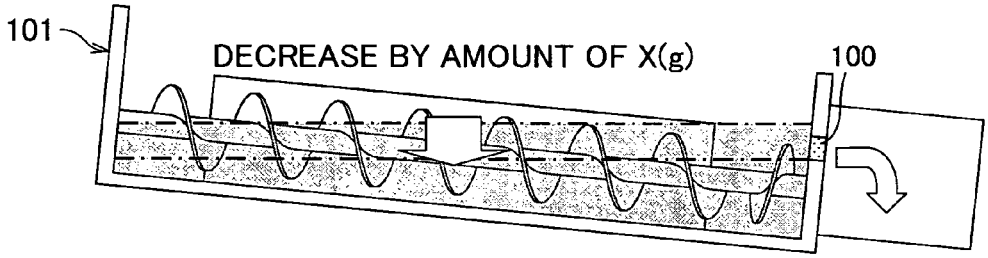
Figure 16:
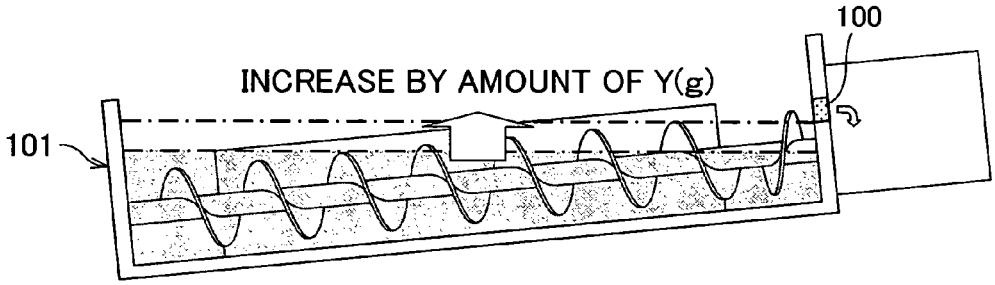

On the other hand, in the conventional developing device (having the identical structure with the developing device 13 except that only the discharging opening equivalent to the discharging opening 20A is provided and no discharging opening equivalent to the discharging opening 20B is provided), when the developing device is inclined so that the end portion having the discharging opening becomes lower than the other end, the amount of the developer in the developing device becomes constant after becoming Z+Y(g) (see FIG. 16(*c*)). Specifically, when the developing device is inclined in such a manner, the surface level of the developer in the vicinity of the discharging opening lowers. This allows no developer to be discharged until the developer is further added and the surface level of the developer reaches the bottom surface of the discharging opening. As a result, the amount of the developer Z(g) is increased by the amount of Y(g). When the amount of the developer in the developing device is increased and becomes Z+Y(g), the rate of discharging the developer and the rate of replenishing the developer become equal. As a result, the amount of the developer in the developing device becomes constant.

As described above, according to the present embodiment, when the developing device 13 is inclined in a range shown in FIGS. 5(*a*) through 5(*c*), the stabilized amount of the developer in the developing device changes in a range from Z−X(g) to Z(g). That is, the stabilized amount of the developer changes by the amount of X(g). On the contrary, in the conventional developing device, when the developing device is inclined in a range shown in FIGS. 16(*a*) through 16(*c*), the stabilized amount of the developer in the developing device changes in a range from Z−X(g) to Z+Y(g). Thus, the stabilized amount of the developer changes by the amount of X+Y(g). That is, the developing device 13 of the present embodiment suppresses the range of changes in amount of the developer due to the inclinations of the developing device.

In the developing device 13 shown in FIG. 4, the discharging openings 20A and 20B are disposed downstream in the respective transport directions of the agitating screws 133 and 134. However, according to the technology disclosed herein, a developing device may be arranged such that (i) discharging openings for discharging an excess of developer are disposed on respective side surfaces located opposite the axial directions of agitating screws, and such that (ii) bottom surfaces of the discharging openings are at a horizontal level when the developing device is set on a horizontal plane.

Figure 6:
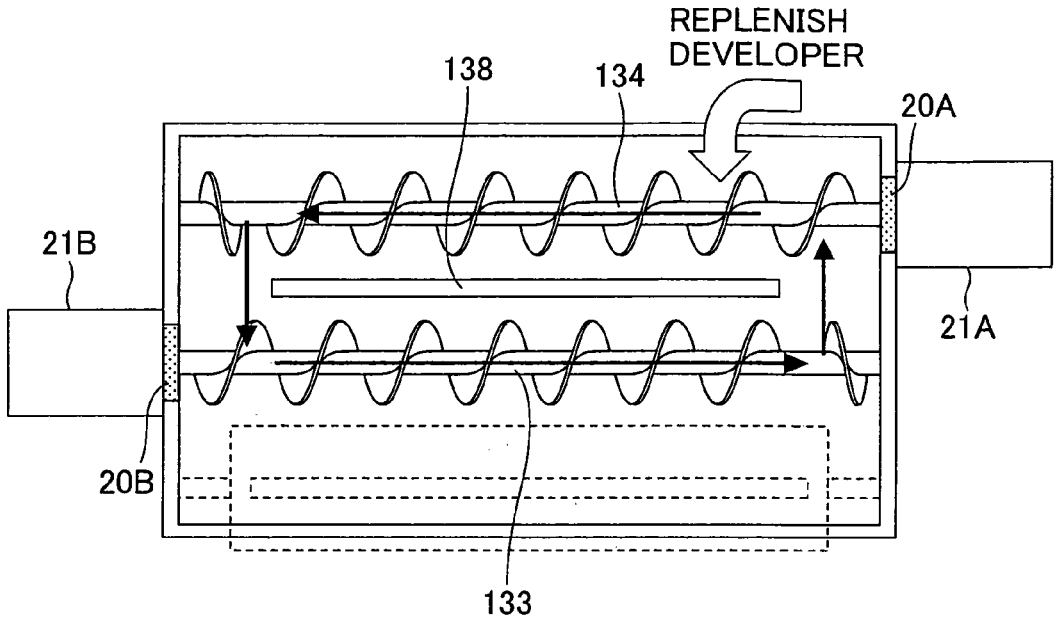
FIGS. 6(*a*) and 6(*b*) are views illustrating modification examples with regard to the layout of discharging openings of the developing device of the embodiment.
Figure 6:
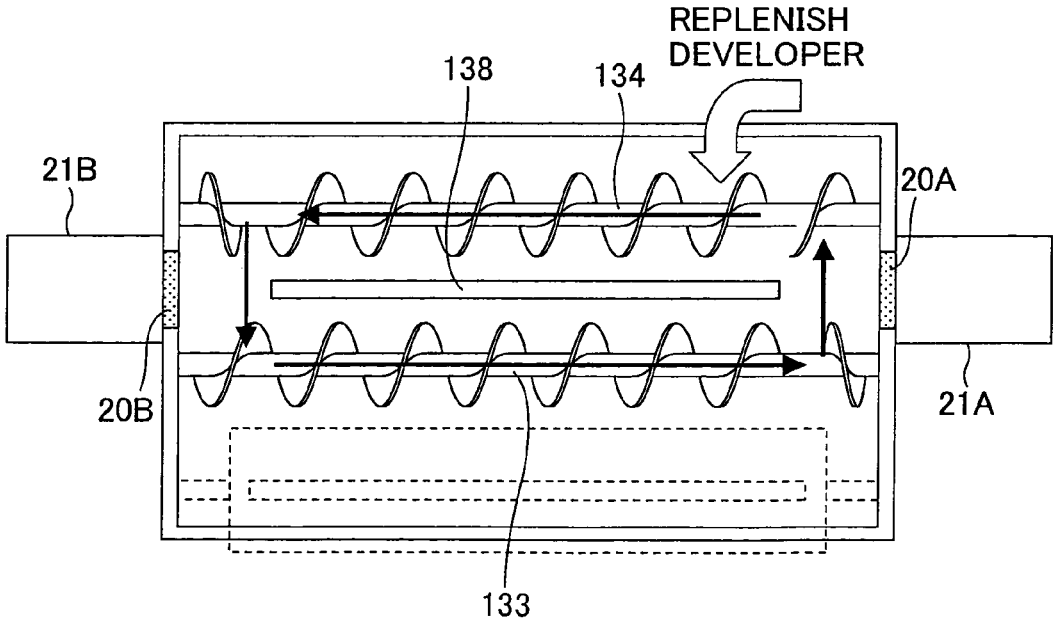

Thus, the positions of the discharging openings 20A and 20B are not limited to the structure shown in FIG. 4, and may be those shown in FIGS. 6(*a*) and 6(*b*). Specifically, FIG. 6(*a*) shows a structure in which the discharging openings 20A and 20B are disposed upstream in the respective transport directions of the agitating screws 133 and 134. FIG. 6(*b*) also shows a structure in which the discharging openings 20A and 20B are disposed between the axes of the agitating screws 133 and 134.

In the structure shown in FIG. 4, even when the developer is replenished through a portion located at the uppermost stream of the agitating screw 134, the developer thus replenished will not be discharged immediately. This is because the developer is agitated and transported from the uppermost stream to the lowermost stream of at least a single axis, i.e., the agitating screw 134. Further, the layout shown in FIG. 4 is excellent since the developer can be replenished through a portion farthest away from a development roller.

In the structure shown in FIG. 6(*a*), the discharging openings 20A and 20B are disposed upstream in the respective transport directions of the agitating screws 133 and 134. In the structure shown in FIG. 6(*a*), the agitating screws 133 and 134 transport the developer in the vicinity of the discharging openings 20A and 20B so that the developer is pulled away from the discharging openings 20A and 20B. Thus, it is expected that transporting operation of the agitating screws 133 and 134 suppress excessive discharge of the developer, even when the developing device is extremely inclined and a large amount of the developer is poured in the discharging openings 20A and 20B.

Further, in the structure shown in FIG. 6(*b*), the discharging openings 20A and 20B are disposed at substantially the middle portion between the axes of the agitating screws 133 and 134. In the structure shown in FIG. 6(*b*), when the developing device is inclined in a direction in which the agitating screws 133 and 134 are arranged (in a direction orthogonal to the axial directions of the agitating screws), changes in the surface level of the developer in the vicinity of the discharging openings 20A and 20B will not be too large. Thus, it is expected to that fluctuations in amount of the developer can be suppressed.

In the exemplary structures shown in FIGS. 4, 6(*a*) and 6(*b*), the discharging openings 20A and 20B are symmetric with respect to a center point of the partition 138 (a center point of the length and the thickness of the partition), when the developing device is viewed from above. This is because, if the discharging openings 20A and 20B are not symmetric with respect to the center point of the partition, the surface level of the developer in the developing device will change significantly when developing device is inclined in the direction in which the agitating screws 133 and 134 are arranged (the direction orthogonal to the axial directions of the agitating screws).

That is, in the structures shown in FIGS. 4 and 6(*a*), the discharging openings 20A and 20B are diagonally opposite to each other with regard to the axial direction of the agitating screws and also with regard to the direction in which the agitating screws are arranged (the direction orthogonal to the axial direction of the agitating screws). Thus, it is expected that the similar effects can be obtained also in a case where the developing device is inclined in the direction in which the agitating screws are arranged. Further, in the structure shown in FIG. 6(*b*), the discharging openings 20A and 20B are disposed in parallel to the axial direction of the agitating screws. This allows transport pipes for discharging developer to be disposed in parallel to the axial direction of the agitating screws, allowing the developer discharged through plural discharging openings to be easily transported in a lump.

Further, in the structures shown in FIGS. 6(*a*) and 6(*b*), if the developer is replenished through a portion at the uppermost stream of the agitating screw 134 as shown in the exemplary structure of FIG. 4, the portion, through which the developer is replenished, becomes too close to the discharging opening 20A. This may cause the replenished developer to be discharged immediately. Regarding this, as shown in FIGS. 6(*a*) and 6(*b*), the developer is replenished through a portion provided slightly away from the uppermost position of the agitating screw 134, so that the aforementioned problem can be solved.

In order to test the effects of a developing device of the technology disclosed herein, experiments were carried out using an image forming apparatus to which the developing device was applied. The following explains results of the experiments. Note that, in the following explanation, an image forming apparatus is a modified AR-450M made by Sharp corporation, and a developing device is arranged such that discharging openings for discharging an excess of developer are disposed in the middle portions between axes of agitating and transporting sections (i.e., agitating screws) (as shown in FIG. 6(*a*)). Further, as a developer, AR-450M pure developer is used, and a weight percentage toner concentration is set to be 5%.

In the experiments, development was not actually carried out and the developer was just circulated in a developer tank by rotation of the agitating and transporting sections. The developer tank was filled beforehand with the developer with an amount slightly larger than a predetermined amount, and no carrier and toner was replenished. Since the amount of the developer in the developing device was larger than the predetermined amount, an excess of the developer was discharged through the discharging openings. This caused a reduction in amount of the developer in the developing device, further causing a reduction in rate of discharging the developer.

At regular time intervals, measurements were carried out with regard to (i) the amount of the developer in the developing device and (ii) the rate of discharging the developer, and their characteristics were observed. Specifically, in order to obtain the rate of discharging the developer, the amount of the developer discharged in a measuring time was measured and then the amount of the discharged developer was divided by the measuring time. Further, in order to obtain the amount of the developer in the developing device at this point, an accumulated amount of the discharged developer was extracted from the initial amount of the developer.

In the AR-450M image forming apparatus, printing was carried out on 40 sheets of A4 size per minute at a printing rate of 2%, while a developer with a concentration of 70% was replenished. Under this condition, the developer was discharged at a rate of 0.1 (g/minute). Since a commonly used printing rate is approximately 5%, the printing rate of 2% is less than half the rate of the commonly used 5%. Thus, the discharge rate of 0.1 (g/minute) is sufficiently small amount for the rate of discharging an excess of the developer.

Regarding this, in the experiments, the measurements were finished when the discharge rate reached 0.1 (g/minute). When the discharge rate was 0.1 (g/minute), the amount of the developer became a minimum value that provides stability in amount of the developer in actual use.

Figure 7:
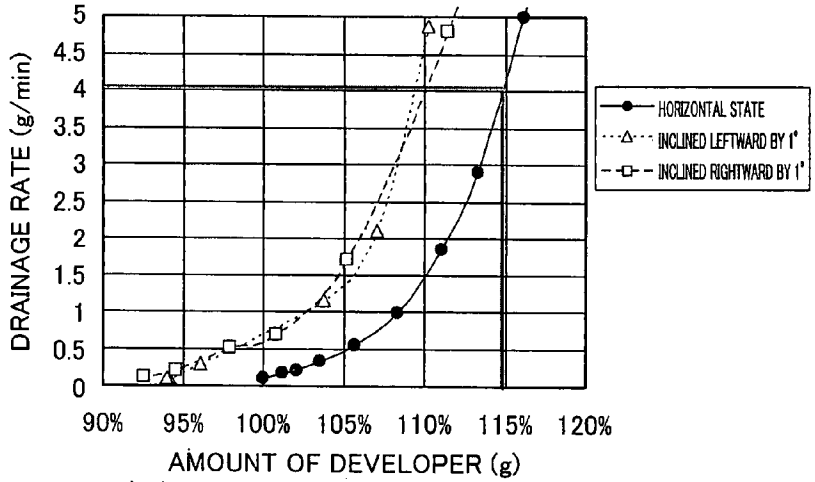
FIG. 7(*a*) is a graph showing a relationship between an amount of developer and a discharge rate in the developing device of the embodiment, and FIGS. 7(*b*) and 7(*c*) are graphs showing relationships between an amount of developer and a discharge rate in conventional developing devices.
Figure 7:
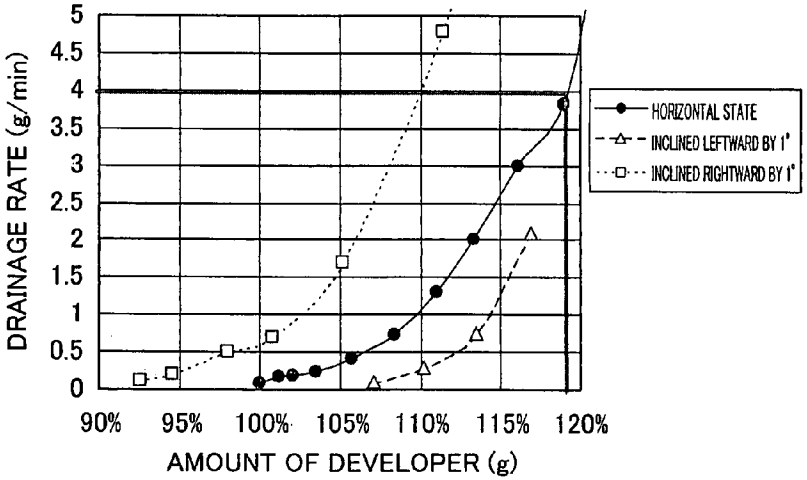
Figure 7:
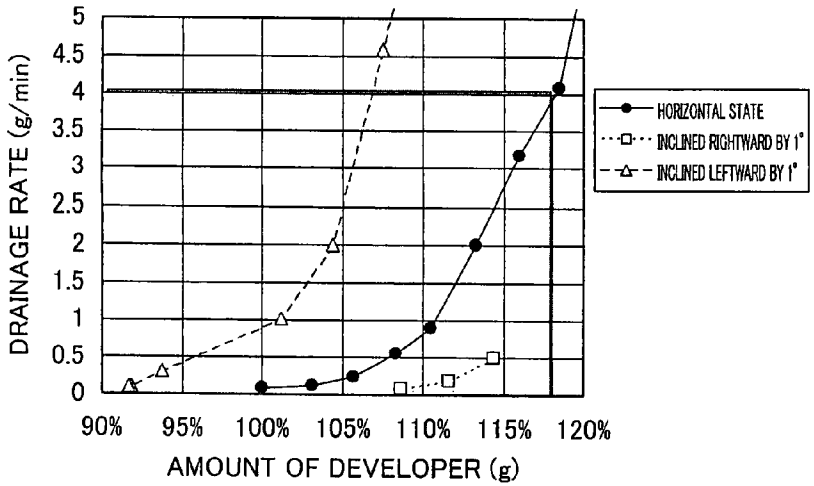

FIGS. 7(*a*) through 7(*c*) show results of the experiments. FIG. 7(*a*) is a graph showing an amount of the developer and a discharge rate in the image forming apparatus to which the developing device of the present embodiment was applied. FIGS. 7(*b*) and 7(*c*) are graphs shown as Comparative Examples. Each of the graphs shows an amount of developer and a discharge rate in an image forming apparatus to which the developing device of the present embodiment was not applied. That is, FIG. 7(*b*) shows a result of the experiment using a developing device that has only the discharging opening 20A shown in FIG. 6(*b*) as a discharging opening for discharging an excess of developer. Further, FIG. 7(*c*) shows a result of the experiment using a developing device that has only the discharging opening 20B shown in FIG. 6(*c*) as a discharging opening for discharging an excess of developer.

FIGS. 7(*a*) through 7(*c*) show the results of the measurements taken under the following three conditions: (i) a developing device is in a horizontal state; (ii) the developing device is inclined in the axial direction of the agitating and transporting sections so that one end having the discharging opening 20A becomes lower than the other end (the developing device is inclined rightward in FIG. 6(*b*)); and (iii) the developing device is inclined in the axial direction of the agitating and transporting sections so that one end having the discharging opening 20B becomes lower than the other end (the developing device is inclined leftward in FIG. 6(*b*)). In the cases where the developing device was inclined, an angle of 1° was given (an angle which the axes of the agitating and transporting sections form with a horizontal plane).

In FIGS. 7(*a*) through 7(*c*), an amount of developer is shown with the abscissa axis. As to the amount of the developer, 100% is set for an amount obtained when the discharge rate becomes stable, i.e., 0.1 (g/minute), in the horizontal state. FIG. 7(*b*) shows the result obtained in the developing device having only the discharging opening 20A. Compared to the amount in the horizontal state, the amount of the developer was increased by 7.0% when the device was inclined leftward, and the amount of the developer was decreased by 14.5% when the device was inclined rightward. Thus, the range of the changes was 14.5%. Further, FIG. 7(*c*) shows the result obtained in the developing device having only the discharging opening 20B. Compared to the amount in the horizontal state, the amount of the developer was decreased by 8.4% when the device was inclined leftward, and the amount of the developer was increased by 7.3% when the device was inclined rightward. Thus, the range of the changes was 15.7%.

On the contrary, FIG. 7(*a*) shows the result of an example to which the technology disclosed herein was applied. In this application example, even when the developing device was inclined leftward and rightward, an increase and a decrease in the amount of the developer were less than 7.4%, from the amount in the horizontal state. Thus, the range of the changes was within 7.4%. With the above results, it was confirmed that the technology disclosed herein reduced changes in amount of the developer in the developing device due to the inclinations of the developing device.

Further, in the example shown in FIG. 7(*a*) to which the present application was applied, even when the developing device is in the horizontal state, the graph shows steep slopes compared to the graphs of examples to which the present invention was not applied (i.e., the discharge rate of the developer of the application example is greater than those of the examples to which the technology disclosed herein was not applied, under the condition where the same amount of the developer existed in the developing devices). This is because an excess of the developer was discharged through the two discharging openings. When a large volume of printing is consecutively carried out (when a consumption rate of toner is high), the rate of replenishing the toner is increased, causing an increase in amount of the developer in the developing device. However, with the aforementioned characteristic, in a developing device to which the present invention is applied, a speed of discharging the developer through the discharging openings is also significantly increased as the amount of the developer in the developing device is increased. This suppresses an increase in amount of the developer in the developing device, compared to those in the devices to which the technology disclosed herein is not applied.

Actually, in the examples shown in FIGS. 7(*b*) and 7(*c*), when the developing device was in the horizontal state, the amount of the developer increased by 18% to 19% when the discharge rate was 4 (g/minute) (which is equal to the discharge rate when printing is carried out on 100 sheets per minute, with the printing rate of 100%, using developer for replenishment with a weight percentage toner concentration of 90%. On the other hand, in the example shown in FIG. 7(*a*), when the discharge rate was the same value, i.e., 4 (g/minute), an increase in amount of the developer was only 15%.

Figure 8:
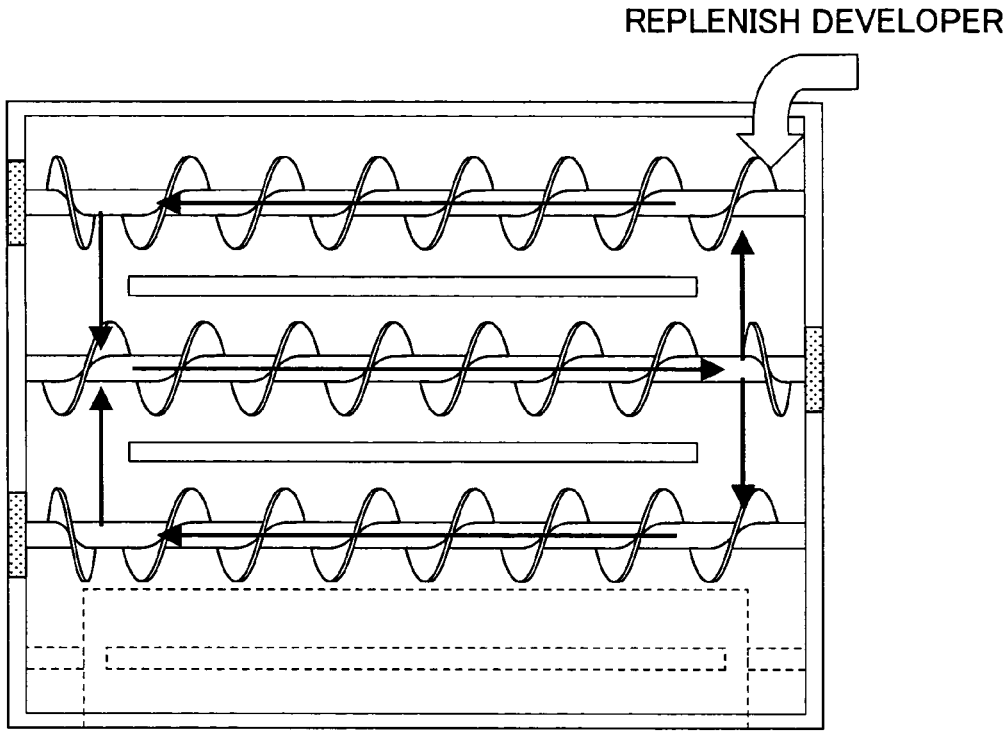
FIG. 8 is a view illustrating a modification example of the developing device of the embodiment.
Figure 9:
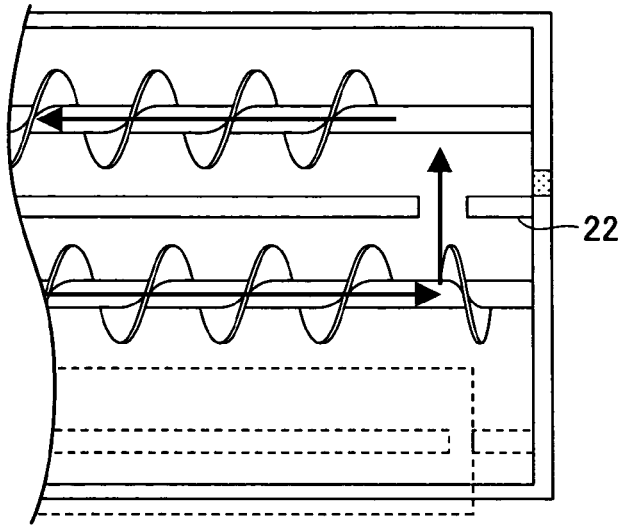
FIG. 9 illustrates a modification example of the developing device of the embodiment.
Figure 9:
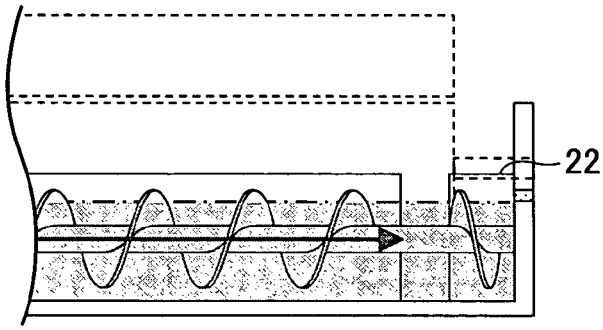

Further, in the developing devices explained above, two agitating screws were provided as agitating and transporting sections by way of example. However, three or more agitating screws may be provided as agitating and transporting sections in order to improve the agitating performance. FIG. 8 shows an exemplary structure of a developing device having three agitating screws.

In the structure shown in FIG. 8, discharging openings are disposed on edges of the developing device in downstream directions in which three agitating screws transport developer. However the positions of the discharging openings are not limited to this. The discharging openings may be disposed upstream in transport directions of the agitating screws as shown in FIG. 6(*a*), or may be disposed between the axes of the agitating screws as shown in FIG. 6(*b*). By disposing the discharging openings as shown in FIG. 8, three or more agitating screws can be provided. This improves the agitating performance, while achieving stability in amount of the developer.

Further, when the discharging openings are disposed between the agitating screws as shown in FIG. 6(*b*), members 22 may be disposed at portions in the vicinity of the discharging openings 20A and 20B, specifically, in upstream directions in which developer is transported. This provides further stability in amount of the developer in the developing device. In the vicinity of the discharging openings 20A and 20B, because the directions in which the developer is transported are switched, (i) the pressure for transporting the developer and (ii) the surface level of the developer tends to become high. The members 22 serve to prevent the surface level of the developer from rising, so as to contribute to the stability in amount of the developer in the developing device.

Figure 10:
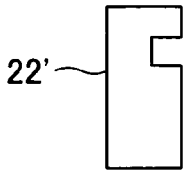
FIG. 10 is a view illustrating a modification example of a member used in the developing device shown in FIG. 9.

The members 22 have a height equal to that of the partition 138, and may be adhered to a side wall on which the discharging openings 20A and 20B are disposed. Further, as an modification example of the members 22, a member 22' shown in FIG. 10 may be provided that has a height equal to that of the discharging openings 20A and 20B and a cutout portion.

In the above explanation, by way of example, the discharging openings 20A and 20B, through which an excess of the developer in the developing device is discharged, are disposed on the side surfaces to which the axial directions of the agitating screws serving as agitating and transporting sections extend (i.e., the side surfaces to which the axes of the agitating screws are orthogonal). However, the technology disclosed herein is not limited to this, and the discharging openings may be disposed on a side surface along which the agitating screws are provided or on the partition (i.e., a side surface being parallel to the axes of the agitating screws or on the partition).

Figure 11:
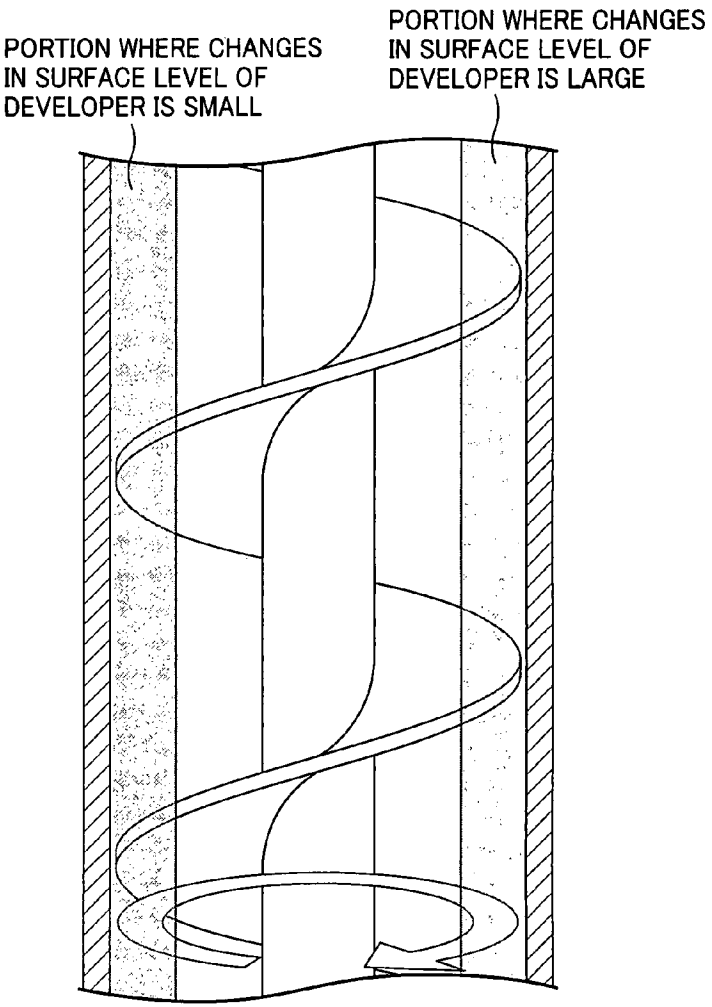
FIGS. 11(*a*) and 11(*b*) are views illustrating a condition of a surface of a developer in the vicinity of an agitating screw in rotary motion.
Figure 11:
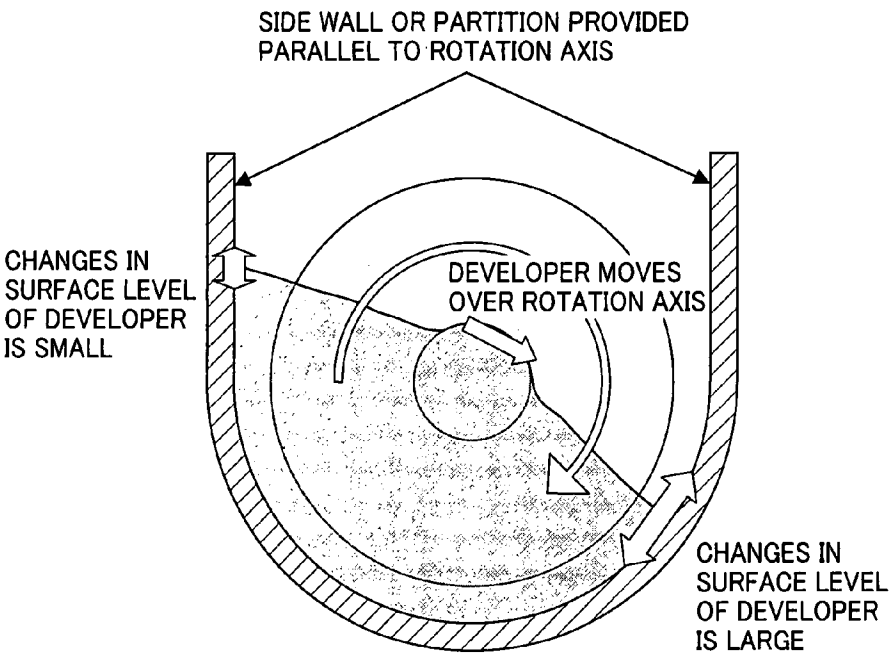

FIGS. 11(*a*) and 11(*b*) show a condition of the surface of developer in the vicinity of an agitating screw. FIG. 11(*a*) shows the condition viewed from a point to which a rotation axis of the agitating screw extends and from which the agitating screw is seen as being rotating in a clockwise direction. Further, FIG. 11(*b*) shows the condition shown in FIG. 11(*a*), when viewed from above. In FIG. 11(*b*), the developer is transported in a downward direction. However, the direction in which the developer is transported is not particularly limited to this. Even in a case where a screw having a reverse rolling direction is used and the developer is transported in an upward direction, the following discussion is similarly applied.

In FIG. 11(*a*), on the left side of the rotation axis, the developer is pushed upward due to the rotation of the agitating screw, so that the surface level of the developer rises. On the contrary, on the right side of the rotation axis, the developer is pulled in, so that the surface level of the developer lowers. Since the developer raised upward on the left side is moved over the rotation axis of the agitating screw toward the right side, the rise in the surface level of the developer on the left side is suppressed to a certain level. This operation reduces changes in the surface level of the developer on the left side of the rotation axis (i.e., on the side in which the developer is transported from a lower place to an upper place in response to the rotation of the screw) due to the increase in amount of the developer in the developing device. On the contrary, on the right side of the rotation axis (i.e., on the side in which the developer is transported from an upper place to a lower place in response to the rotation of the screw), the above operation causes large changes in the surface level of the developer due to the increase in amount of the developer. Further, with regard to fluctuations in amount of the developer due to the inclinations of the developing device, similarly, the range of changes in the surface level of the developer becomes small on the left side of the rotation axis of the agitating screw, while becoming large on the right side of the rotation axis.

As such, movements of the surface level of the developer are considerably different between the right side and the left side of the rotation axis of the agitating screw. This means that characteristics of a discharging opening for discharging the developer will be different depending on which side of the rotation axis of the agitating screw the developer discharging opening is disposed on.

Figure 12:
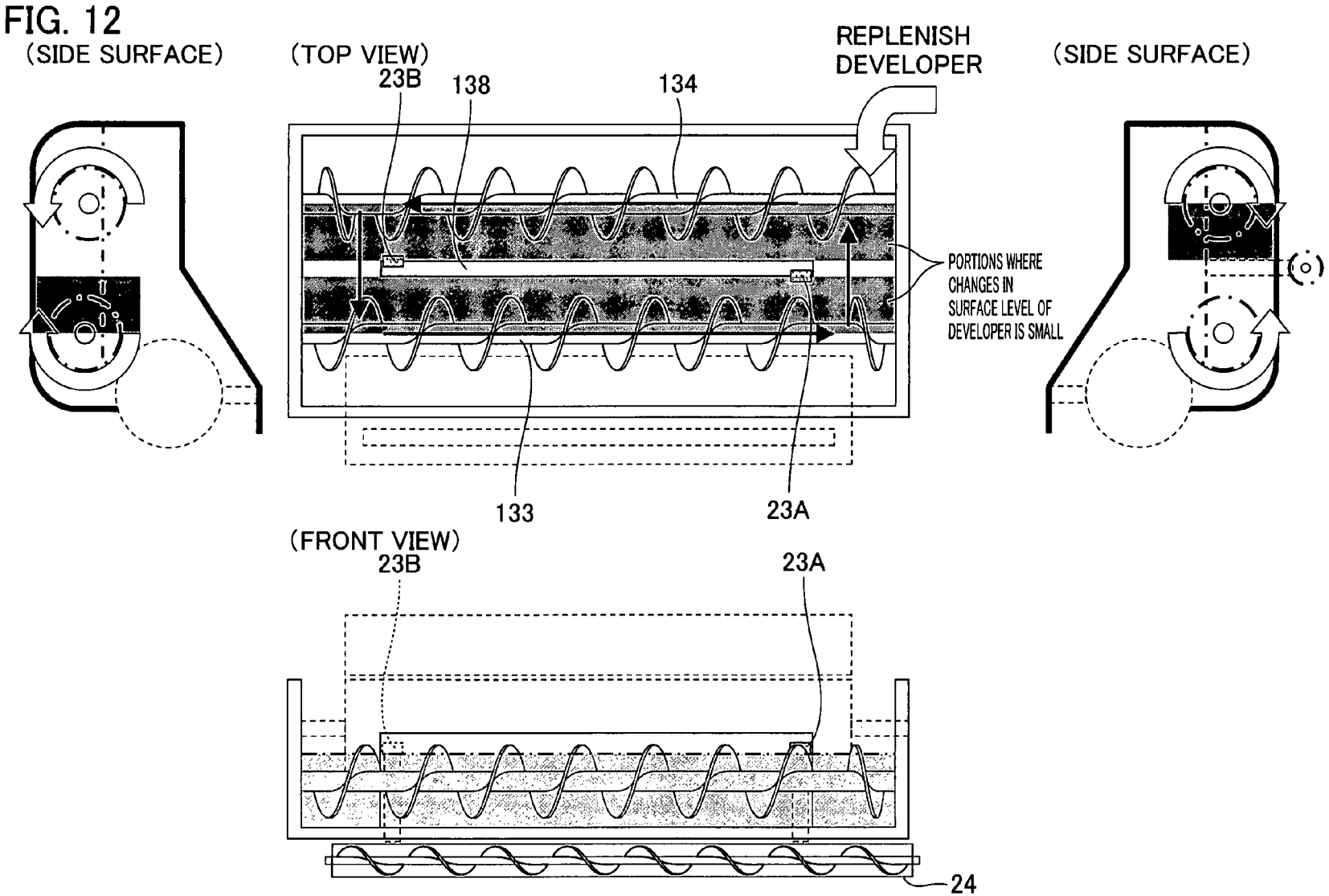
FIG. 12 is a projected view illustrating a modification example of the developing device of the embodiment.

In the structure shown in FIG. 12, agitating screws 133 and 134 rotate in respective directions so that the surface level of the developer rises on the sides close to the partition 138. That is, the structure shown in FIG. 12 allows a reduction in the range of changes in the surface level of the developer on the sides close to the partition 138 with respect to the agitating screws 133 and 134. Further, discharging openings 23A and 23B for discharging an excess of the developer are disposed on the partition 138, specifically at a level equal to a predetermined height of the surfaces located opposite the agitating screws 133 and 134, respectively. Further, the developer discharged through the discharging openings 23A and 23B is passed via discharging pipes provided inside the partition 138, so as to be discharged through the bottom surface of the developing device.

In the structure shown in the FIG. 12, as is the case with the structure shown in FIG. 4, it is expected that changes in amount of the developer in the developing device will be too large when the developing device is inclined in both the axial direction of the agitating screws and the direction in which the agitating screws are arranged. Further, by providing a transport pipe 24 for discharging the developer below the partition 138, it is possible to easily collect the developer discharged through the plural discharging openings, i.e., the discharging openings 23A and 23B.

Further, considering a rotative direction of each development roller, there may be a case where the structure shown in FIG. 12 is arranged such that agitating screws rotate in reversed directions. In a structure shown in FIG. 13, rotative directions of the agitating screws 133 and 134 are opposite to those shown in FIG. 12, and the discharging openings 23A and 23B are disposed as shown in FIG. 12. That is, in the structure shown in FIG. 13, rolling directions of the agitating screws 133 and 134 are opposite to those in the structure shown in FIG. 12. In the structure shown in FIG. 13, since the rotative directions of the agitating screws 133 and 134 are opposite to those shown in FIG. 12, the developer in the vicinity of the discharging openings 23A and 23B is transported from an upper place to a lower place in response to the rotation of the screws. Despite such movements of the developer, since the discharging openings 23A and 23B in FIG. 13 maintain the same characteristics as those in FIG. 12, the structure of FIG. 13 also achieves excellent performance with regard to fluctuations in amount of the developer due to the inclinations of the developing device.

Figure 13:
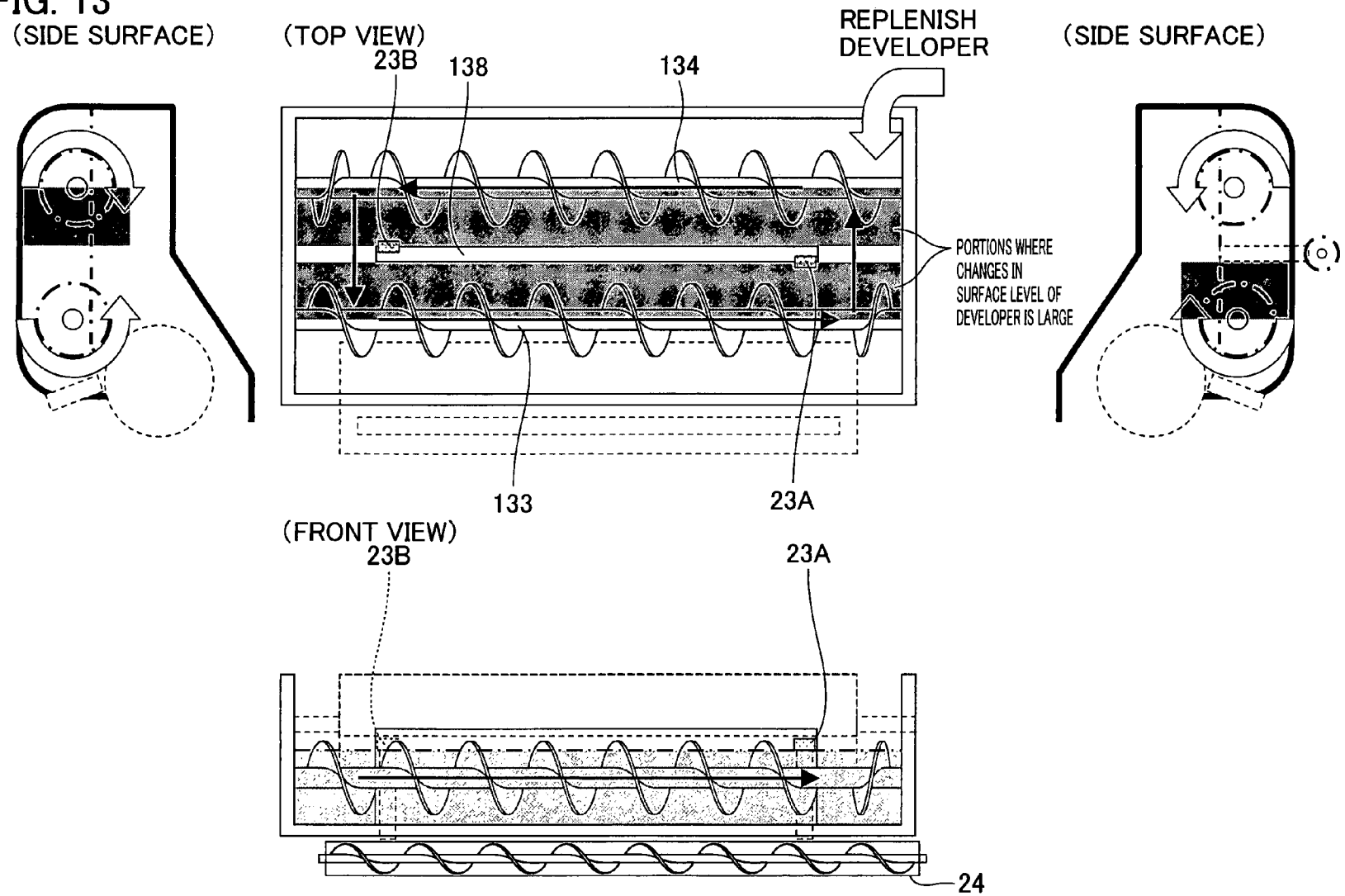
FIG. 13 is a projected view illustrating a modification example of the developing device of the embodiment.

In the structures shown in FIGS. 12 and 13, the discharging openings 23A and 23B are disposed on both ends of the partition 138 in its longitudinal direction. This allows the discharging openings 23A and 23B to have (i) reverse characteristics with regard to fluctuations in amount of the developer when the developing device is inclined in the axial direction of the agitating screws, and (ii) the same characteristics with regard to changes in discharge rate in response to the fluctuations in amount of the developer. As a result, excellent performance is achieved with regard to the fluctuations in amount of the developer due to the inclinations of the developing device is inclined.

Figure 14:
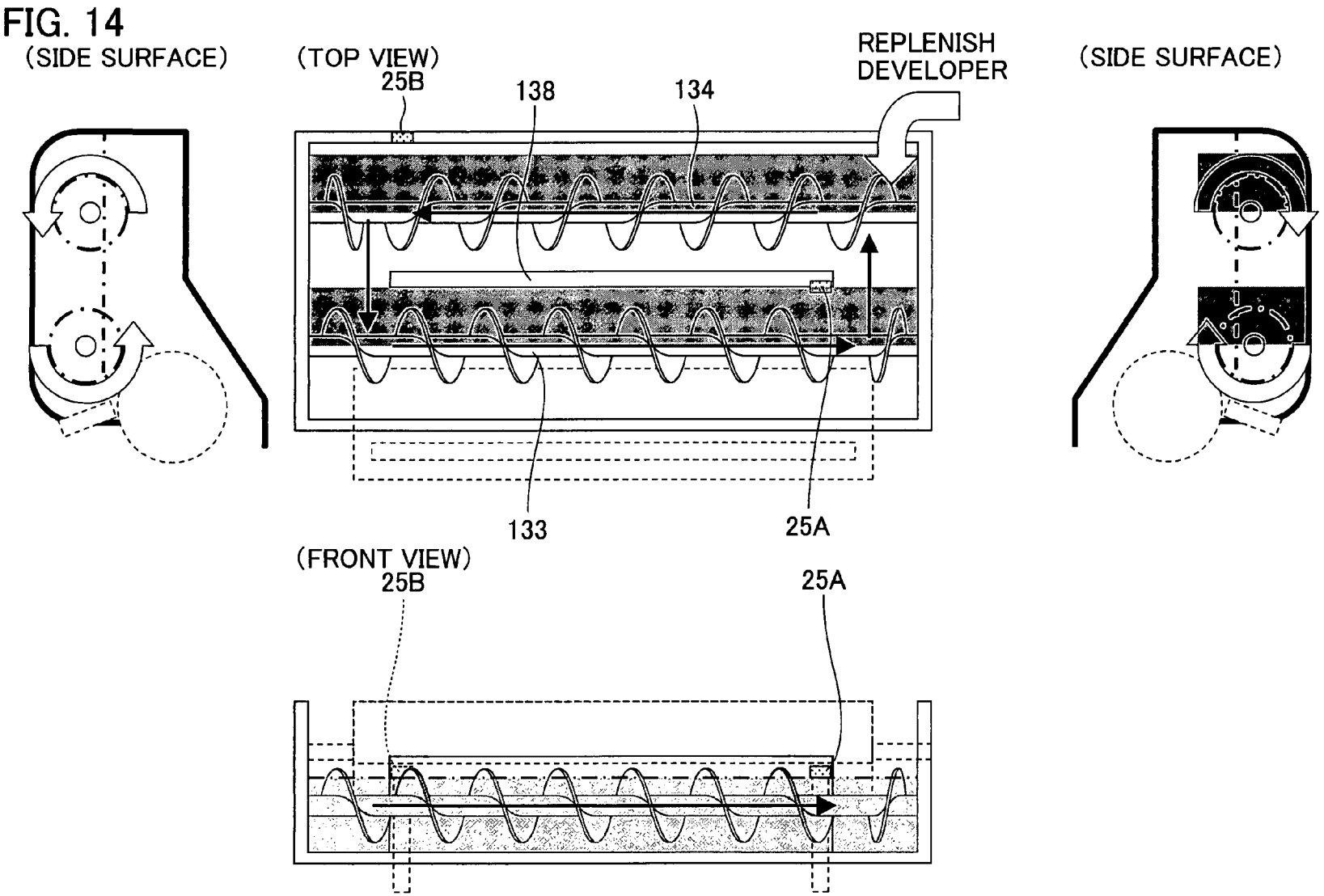
FIG. 14 is a projected view illustrating a modification example of the developing device of the embodiment.

In the structures shown in FIGS. 12 and 13, the discharging openings 23A and 23B are disposed on both side of the partition 138 in the vicinity of its right and left edges, respectively. However, the positions of the discharging openings 23A and 23B are not limited to this. Assume a case where the rotative directions of the agitating screws are defined as shown in FIG. 14, considering operations of gear trains and agitating performance. Even in this case, by disposing discharging openings 25A and 25B at the positions indicated in FIG. 14, the discharging openings 25A and 25B have reverse characteristics with regard to fluctuations in amount of the developer when the developing device is inclined in the axial direction of the agitating screws, while having the same characteristics with regard to changes in discharge rate in response to the fluctuations in amount of the developer. As a result, excellent performance is achieved with regard to the fluctuations in amount of the developer due to the inclinations of the developing device.

Figure 15:
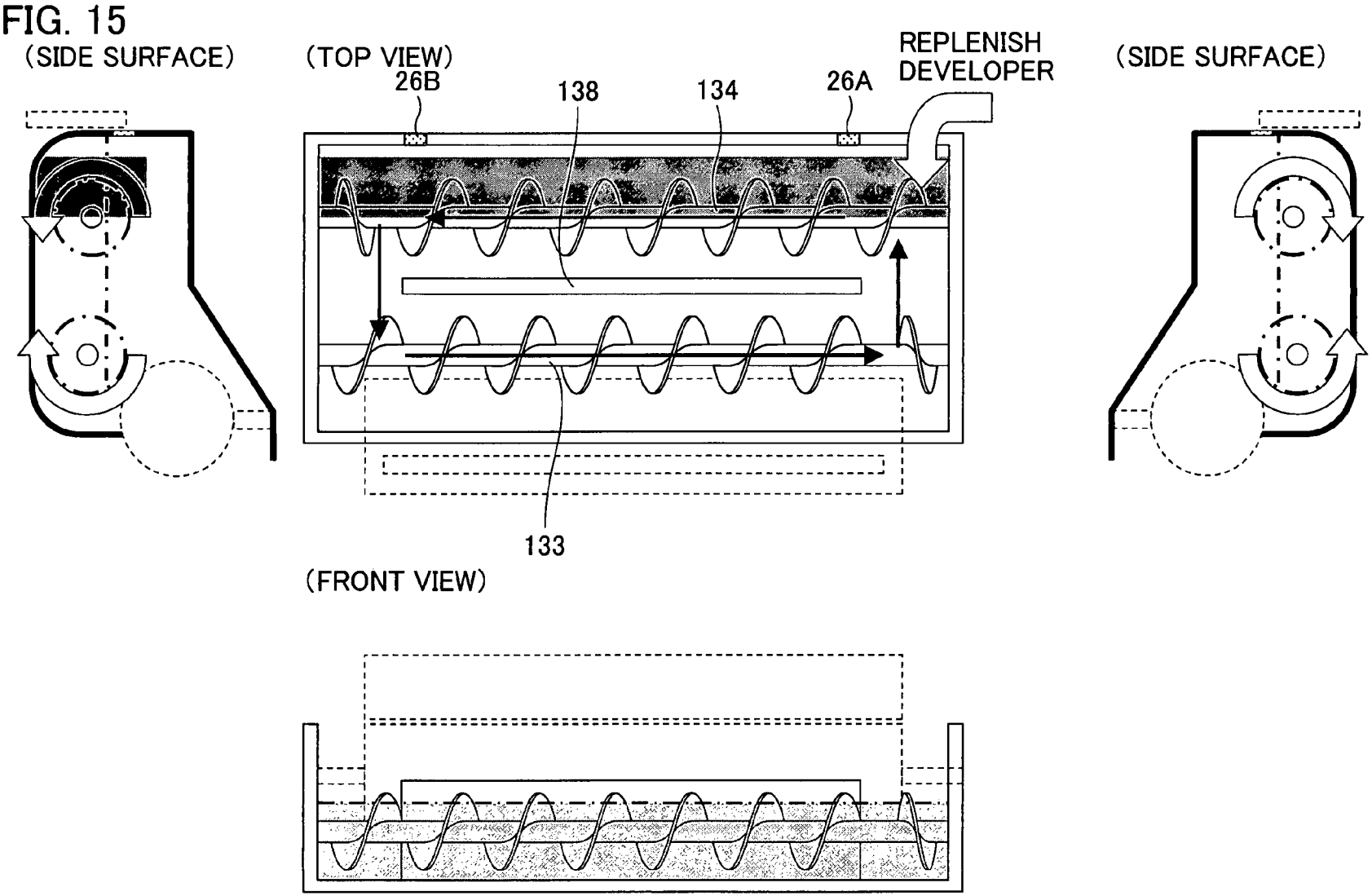
FIG. 15 is a projected view illustrating a modification example of the developing device of the embodiment.

Further, in the structure shown in FIG. 15, a rotative direction of the agitating screw 134 is arranged such that the surface level of the developer changes significantly on the side opposite the partition 138. In this case, discharging openings 26A and 26B may be disposed on a side wall located opposite the partition 138 with respect to the agitating screw 134. In the similar manner described above, the discharging openings 26A and 26B have reverse characteristics with regard to fluctuations in amount of the developer due to the inclinations of the developing device in the axial direction of the agitating screws, while having the same characteristics with regard to changes in discharge rate in response to the fluctuations in amount of the developer. As a result, excellent performance is achieved with regard to the fluctuations in amount of the developer due to the inclinations of the developing device. In the structure shown in FIG. 15, the discharging openings 26A and 26B are disposed on the side surface located opposite a development roller. However, the positions of the discharging openings are not limited to this.

In the above explanation, the discharging openings for discharging an excess of the developer serves to discharge the developer, which exceeds the level equal to the bottom surface of the discharging openings and overflows, to the outside of the developing device. Inside the discharging openings, a screw member or the like may be disposed that facilitates discharge of the developer.

As described above, a developing device of the technology disclosed herein in which a two component developer including toner and carrier is supplied into a developer tank, which developer tank includes developer discharging openings for discharging an excess of the two component developer in response to replenishment of the two component developer, the number of the developer discharging openings being at least one provided in the vicinity of each edge of the developing device in a longitudinal direction of the developing device.

Thus, when the developing device is inclined toward any side in its longitudinal direction, at least one of the developer discharging openings lowers. This may cause a reduction in amount of the developer in the developing device due to the inclination of the device. However, no increase occurs in the amount. As a result, it is possible to reduce changes in amount of the developer due to the inclinations of the developing device.

Further, the developing device may be arranged such that the excess of the developer is overflowed and discharged through the developer discharging openings when the two component developer has a level exceeding a bottom edge of the developer discharging openings.

According to the arrangement, as means for suppressing changes in amount of the developer due to the inclinations of the developing device, the developer discharging openings does not require an opening and closing mechanism such as a shutter member, and other means such as control means for the opening and closing mechanism, or the like. Thus, a developing device can be provided with low cost that has a simple structure and suppresses changes in amount of the developer.

Further, the developing device may be arranged such that said developer tank includes at least two agitating chambers which are partitioned by a partition so that communicating portions are formed at both edges of the partition, and each of the agitating chambers includes an agitating and transporting section.

According to the arrangement, the plural agitating chambers, partitioned by the partition, are communicated so that paths for circulating the developer are provided. This improves the agitating performance of the developer. Further, the partition prevents the developer not agitated from coming close to a development roller. This contributes to achieve high image quality.

Further, in the developing device, the agitating and transporting section may be a screw member.

According to the arrangement, unlike an agitator or the like, the screw member is capable of transporting the developer from a lower place to an upper place against gravity, by forcedly circulating the developer. This reduces unevenness of the developer in the developing device, thereby suppressing changes in amount of the developer in response to the inclinations of the device. Further, if the developing device is applied to a color coping machine that has a critical requirement regarding image quality, it is possible to achieve good agitating performance by using the screw member.

Further, the developing device may be arranged such that each of the developer discharging openings is provided in the vicinity of upstream of the agitating and transporting section in each transport direction of the agitating and transporting section in each of the agitating chambers.

Further, the developing device may be arranged such that each of the developer discharging openings is provided in the vicinity of downstream of the agitating and transporting section in each transport direction of the agitating and transporting section in each of the agitating chambers.

Further, the developing device may be arranged such that, in the two agitating chambers being adjacent to each other sandwiching the partition, the developer discharging openings are provided on side walls of the two agitating chambers and between axes of the two agitating and transporting sections in the two agitating chambers, the axes being attached to bearing sections of the side walls.

According to the arrangements, the two developer discharging openings are disposed so as to be, for example symmetric with respect to a point or line, i.e., the center point of the partition. This allows the two developer discharging openings to have similar characteristics for discharge, so as to lessen the dependency of the characteristics of discharging the developer on a side to which the developing device is inclined.

Further, the developing device may be arranged such that, when viewed from points to which rotation axes of the agitating and transporting section extends and from which the agitating and transporting section is seen as being rotating in a clockwise direction, the developer discharging openings are provided on a side wall of the agitating chambers or on the partition, which are located on respective left sides of the agitating and transporting section, respectively provided in the agitating chambers.

Alternatively, the developing device may be arranged such that, when viewed from points to which rotation axes of the agitating and transporting section extends and from which the agitating and transporting section is seen as being rotating in a clockwise direction, the developer discharging openings are provided on a side wall of the agitating chambers or on the partition, which are located on respective right sides of the agitating and transporting section, respectively provided in the agitating chambers.

According to the arrangement, the plural developer discharging openings are disposed at the portions around which movements of the developer are similar, facilitating suppression of the range of changes in amount of the developer.

Further, in the developing device in which the number of the agitating chambers is two, when viewed from a point to which the partition extends in a longitudinal direction thereof, an agitating and transporting section located on the right side of the partition rotates in a clockwise direction, and an agitating and transporting section located on the left side of the partition rotates in a counterclockwise direction, and the developer discharging openings are disposed on the partition in the respective agitating chambers.

Alternatively, in the developing device in which the number of the agitating chambers is two, when viewed from a point to which the partition extends in a longitudinal direction thereof, an agitating and transporting section located on the right side of the partition rotates in a counterclockwise direction, and an agitating and transporting section located on the left side of the partition rotates in a clockwise direction, and the developer discharging openings are disposed on the partition in the respective agitating chambers.

Further, the developing device may further include a transport pipe for transporting developer discharged through the discharging openings in a lump.

According to the arrangement, the developer discharged through the plural developer discharging openings in a lamp is transported to the transport pipe. This provides a simple mechanism for transporting the discharged developer to a box for discharged toner, enabling to realize a low-cost developing device.

The present invention is not limited to the description of the embodiments above, but may be altered by a skilled person within the scope of the claims. An embodiment based on a proper combination of technical means disclosed in different embodiments is encompassed in the technical scope of the present invention.

What is claimed is:

1. A developing device in which a two component developer including toner and carrier is supplied into a developer tank, which developer tank includes developer discharging openings for discharging an excess of the two component developer in response to replenishment of the two component developer, the number of the developer discharging openings being at least one provided in the vicinity of each edge of the developing device in a longitudinal direction of the developing device; and wherein the excess of the developer is overflowed and discharged through the developer discharging openings when the two component developer has a level exceeding a bottom edge of the developer discharging openings.

2. The developing device according to claim 1, wherein said developer tank includes at least two agitating chambers which are partitioned by a partition so that communicating portions are formed at both edges of the partition, and each of the agitating chambers includes an agitating and transporting section.

3. The developing device according to claim 2, wherein the agitating and transporting section is a screw member.

4. The developing device according to claim 2, wherein each of the developer discharging openings is provided in the vicinity of upstream of the agitating and transporting section in each transport direction of the agitating and transporting section in each of the agitating chambers.

5. The developing device according to claim 2, wherein each of the developer discharging openings is provided in the vicinity of downstream of the agitating and transporting section in each transport direction of the agitating and transporting section in each of the agitating chambers.

6. The developing device according to claim 2, in the two agitating chambers being adjacent to each other sandwiching the partition, the developer discharging openings are provided on side walls of the two agitating chambers and between axes of the two agitating and transporting sections in the two agitating chambers, the axes being attached to bearing sections of the side walls.

7. The developing device according to claim 2, wherein, when viewed from points to which rotation axes of the agitating and transporting section extends and from which the agitating and transporting section is seen as being rotating in a clockwise direction, the developer discharging openings are provided on a side wall of the agitating chambers or on the partition, which are located on respective left sides of the agitating and transporting section, respectively provided in the agitating chambers.

8. The developing device according to claim 7, in which the number of the agitating chambers is two, wherein, when viewed from a point to which the partition extends in a longitudinal direction thereof, an agitating and transporting section located on the right side of the partition rotates in a clockwise direction, and an agitating and transporting section located on the left side of the partition rotates in a counterclockwise direction, and the developer discharging openings are disposed on the partition in the respective agitating chambers.

9. The developing device according to claim 2, wherein, when viewed from points to which rotation axes of the agitating and transporting section extends and from which the agitating and transporting section is seen as being rotating in a clockwise direction, the developer discharging openings are provided on a side wall of the agitating chambers or on the partition, which are located on respective right sides of the agitating and transporting section, respectively provided in the agitating chambers.

10. The developing device according to claim 9, in which the number of the agitating chambers is two, wherein, when viewed from a point to which the partition extends in a longitudinal direction thereof, an agitating and transporting section located on the right side of the partition rotates in a counterclockwise direction, and an agitating and transporting section located on the left side of the partition rotates in a clockwise direction, and the developer discharging openings are disposed on the partition in the respective agitating chambers.

11. A developing device in which a two component developer including toner and carrier is supplied into a developer tank, which developer tank includes developer discharging openings for discharging an excess of the two component developer in response to replenishment of the two component developer, the number of the developer discharging openings being at least one provided in the vicinity of each edge of the developing device in a longitudinal direction of the developing device; and wherein a transport pipe is configured to transport developer discharged through the discharging openings in a lump.

12. An image forming apparatus comprising a developing device in which a two component developer including toner and carrier is supplied into a developer tank, which developer tank includes developer discharging openings for discharging an excess of the two component developer in response to replenishment of the two component developer, the number of the developer discharging openings being at least one provided in the vicinity of each edge of the developing device in a longitudinal direction of the developing device; and wherein the excess of the developer is overflowed and discharged through the developer discharging openings when the two component developer has a level exceeding a bottom edge of the developer discharging openings.

* * * * *